US008869777B2

(12) United States Patent
Espinoza

(10) Patent No.: US 8,869,777 B2
(45) Date of Patent: Oct. 28, 2014

(54) METHOD AND APPARATUS FOR EVAPORATIVE EMISSIONS CONTROL

(71) Applicant: Ford Global Technologies, LLC, Dearborn, MI (US)

(72) Inventor: Robert Joseph Espinoza, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/904,831

(22) Filed: May 29, 2013

(65) Prior Publication Data

US 2013/0247882 A1 Sep. 26, 2013

Related U.S. Application Data

(62) Division of application No. 12/938,426, filed on Nov. 3, 2010, now abandoned.

(51) Int. Cl.
*F02M 33/02* (2006.01)
*F02M 25/08* (2006.01)

(52) U.S. Cl.
CPC ..... *F02M 25/08* (2013.01)
USPC ..... 123/520; 123/198 D; 123/516; 73/114.39

(58) Field of Classification Search
CPC . F02M 25/08; F02M 25/089; F02M 25/0809; F02M 25/0818; F02M 25/0836; B60K 15/03504; B60K 2015/0319; B60K 2015/03576; B60K 2015/03566; F02D 41/0032
USPC ..... 123/516, 518, 519, 520, 521, 198 D; 137/43, 493, 587, 588, 589; 73/114.39
See application file for complete search history.

(56) References Cited

U.S. PATENT DOCUMENTS

| | | | | |
|---|---|---|---|---|
| 4,727,735 | A | 3/1988 | Haag et al. | |
| 4,881,581 | A | 11/1989 | Hollerback | |
| 6,435,164 | B1 | 8/2002 | Kaiser et al. | |
| 6,761,154 | B2 * | 7/2004 | Takagi et al. | 123/520 |

(Continued)

FOREIGN PATENT DOCUMENTS

| | | | |
|---|---|---|---|
| CN | 2704497 | Y | 6/2005 |
| JP | 2008248723 | A | 10/2008 |

*Primary Examiner* — Erick Solis
*Assistant Examiner* — Carl Staubach
(74) *Attorney, Agent, or Firm* — Julia Voutyras; Brooks Kushman P.C.

(57) ABSTRACT

A method of controlling an evaporative emissions system of a vehicle includes determining that a refueling event has been requested by a vehicle occupant, detecting a pressure inside a fuel tank, and impeding opening of a fuel tank inlet if the pressure is above a limit value. After the refueling event, an open/closed status of a fuel inlet access door is monitored, a fuel level inside a fuel tank is monitored, and a vehicle engine an operating condition is monitored. Pressure buildup within the fuel tank is disabled if a) the open/closed status has not changed from closed to open, and b) the fuel level has increased, and c) the vehicle engine is operating. An operator alert may be generated, and/or a fault code may be set in a vehicle diagnostic system.

7 Claims, 3 Drawing Sheets

(56) References Cited

U.S. PATENT DOCUMENTS

| | | | | |
|---|---|---|---|---|
| 6,837,224 | B2 | 1/2005 | Kidokoro et al. | |
| 6,892,712 | B2 * | 5/2005 | Miwa et al. | 123/520 |
| 7,152,587 | B2 * | 12/2006 | Suzuki | 123/518 |
| 7,171,989 | B2 | 2/2007 | Corless et al. | |
| RE41,823 | E * | 10/2010 | Miwa et al. | 123/520 |
| 8,019,525 | B2 * | 9/2011 | DeBastos et al. | 701/102 |
| 2009/0216400 | A1 * | 8/2009 | Larsen et al. | 701/34 |
| 2012/0152210 | A1 * | 6/2012 | Reddy et al. | 123/520 |

* cited by examiner

METHOD AND APPARATUS FOR EVAPORATIVE EMISSIONS CONTROL

CROSS-REFERENCE TO RELATED APPLICATIONS

This application is a division of U.S. application Ser. No. 12/938,426 filed Nov. 3, 2010, the disclosure of which is incorporated in its entirety by reference herein.

TECHNICAL FIELD

This invention relates to evaporative emissions control systems for automotive vehicles, and more specifically to methods and apparatus for identifying conditions that may contribute to fuel vapor leakage prior to or after refueling the vehicle.

BACKGROUND

Many automotive vehicles operating today and powered by internal combustion engines include an evaporative emissions control system. In such systems, vapors that form in the vehicle's fuel tank and associated portions of the fuel system are passed through a recovery canister containing carbon particles that remove or "scrub" hydrocarbons from the air before letting the air exit the fuel system. At certain times during vehicle operation, the vapor recovery canister is "purged" by forcing air though the carbon trap to desorb the hydrocarbons from the carbon, and that air/hydrocarbon mixture is then burned in the engine. Most current evaporative emission control systems operate with the fuel tank at or close to ambient atmospheric pressure, with the small amount of vapor pressure caused by fuel evaporation causing the flow of gasses through the canister. Such systems are referred to in this document as unpressurized.

It has been proposed to even further reduce evaporative emissions by isolating the fuel tank from the down-stream components of the evaporative emissions control system so that leakage of fuel vapors from the tank and related vapor recovery system lines and components is all but eliminated. When the tank is isolated in this manner, normal vaporization of the liquid fuel in the tank will generally cause the tank to become pressurized (above atmospheric pressure) to some degree. If the pressure in the fuel tank is above atmospheric pressure when the vehicle needs to be refueled, the tank pressure should be lowered to be at or near atmospheric pressure by opening an isolation valve so that the fuel vapors in the tank may flow to (and through) the recovery canister. If the positive pressure in tank is not relieved in this way before the refueling inlet is opened, the fuel vapors will escape through the inlet, thereby defeating the hoped-for reduction in evaporative emissions.

SUMMARY

In one disclosed embodiment, a method of controlling an evaporative emissions system of a vehicle comprises determining that a refueling event has been requested by a vehicle occupant, detecting a pressure inside a fuel tank, and impeding opening of a fuel tank inlet if the pressure is above a limit value. This method prevents the escape of fuel vapors through the fuel tank inlet that would result if the inlet were to be opened while the tank was still pressurized.

In another disclosed embodiment, a method of controlling an evaporative emissions system of a vehicle after refueling comprises monitoring an open/closed status of a fuel inlet access door, monitoring a fuel level inside a fuel tank, detecting that a vehicle engine is in an operating condition, and disabling a pressure buildup within the fuel tank if a) the open/closed status has not changed from closed to open, and b) the fuel level has increased, and c) the vehicle engine is operating.

In a further aspect of both of the above embodiments, an operator alert may be generated to notify the operator of the vehicle of the unusual condition, and/or a fault code may be set in a vehicle diagnostic system.

In a another disclosed embodiment, apparatus for controlling evaporative emissions from a fuel system of an automotive vehicle comprises a fuel tank; a tank inlet for adding fuel to the tank; a refueling access door limiting access to the tank inlet; a fuel tank pressure sensor; a vapor recovery canister receiving vapors from the tank; an isolation valve between the tank and the recovery canister and which is closable to allow pressure to increase in the tank; a refuel input device usable by a vehicle occupant to direct opening of the refueling access door; and a controller operatively interfaced with the refueling access door, the pressure sensor, the isolation valve, and the tank refuel input device. The controller acts to impede opening of the refueling access door when the pressure sensor detects an internal tank pressure greater than a threshold pressure.

BRIEF DESCRIPTION OF THE DRAWINGS

Embodiments of the present invention will now be described by way of example only with reference to the accompanying drawings in which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
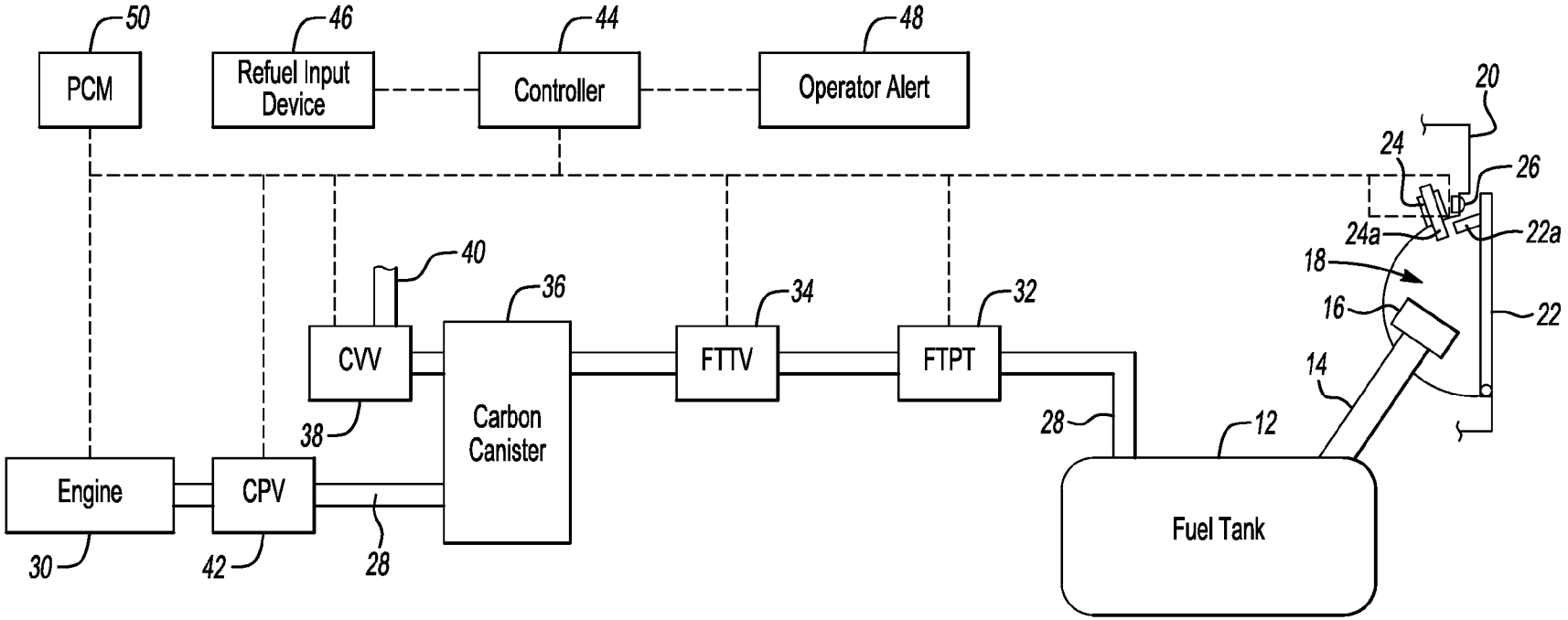
FIG. 1 is a schematic diagram of a pressurized vehicle fuel system.

In the automotive vehicle evaporative emissions control system shown in FIG. 1, a fuel tank 12 is filled with liquid fuel, such as gasoline or gasohol, through a fuel tank inlet 14 during refueling in a conventionally known manner. Fuel tank inlet 14 has an inlet opening 16 that may be fitted with a removable cap (not shown), or it may be of a cap-less design. Inlet opening 16 is located in a refueling compartment 18 adjacent to an exterior vehicle body panel 20. Refueling compartment 18 is closed off by a moveable access door 22 which is shown to be hinged adjacent its lower edge. Door 22 is retained in a closed position by a latch 24, which may be actuated mechanically, electrically, or pneumatically. In the example shown, latch 24 includes a locking plunger 24*a* that extends downwardly to engage a locking tab 22*a* on door 22. Locking plunger 24*a* is retracted to disengage locking tab 22*a* and allow door 22 to be opened in order to allow access to the refueling compartment 18 and inlet opening 16.

FIG. 1 does not include fuel system components related to the flow of liquid fuel from tank 12 to engine 30 for normal engine operation, as these components are not pertinent to the present disclosure.

A door position sensor 26 is located adjacent refueling compartment 18 and detects when door 22 is in a fully closed position. Door sensor 26 may be any appropriate type of contact or contactless sensor of the type well known in the electro-mechanical arts.

The evaporative emissions control system further comprises vapor recovery line 28 connected with tank 12, a fuel tank pressure transducer (FTPT) 32, a fuel tank isolation valve (FTIV) 34, and a vapor recovery canister 36. FTPT 32 is located between tank 12 and FTIV 34 to detect pressure and generates an electric signal indicating the pressure. FTIV 34 may be closed to isolate tank 12 from the other downstream components of the system and opened to allow vapor to flow to canister 36. As is well known in the art, vapor recovery canister 36 contains a material (most commonly carbon particles) that absorbs hydrocarbons from the fuel vapors flowing through vapor recovery line 28 from tank 12. A canister vent valve 38 is operative to alternatively open or close a vent 40 to atmosphere. Vapor recovery line 28 continues from canister 36 towards engine 30 and a canister purge valve (CPV) 42 is located between the engine and the canister.

A controller 44 is in operative communication with transducer 32 and valves 34, 38, and 42 to monitor and control the system in a manner to maintain positive pressure within fuel tank 12 and associated vapor recovery line 28 so that the escape of fuel vapors from the tank is minimized.

Isolation valve 34 is normally closed during engine operation to keep fuel tank 12 pressurized and thereby prevent the escape of vapors until a refueling event. When refueling is required, tank isolation valve 34 is commanded to open by controller 44 and the positive pressure within fuel tank 12 causes fuel vapors to flow through line 28 to recovery canister 36. Canister vent valve 38 is also open at this time so that vapors are able to flow through canister 36 and be scrubbed of hydrocarbon contaminants, with relatively pollution-free gases escaping to the atmosphere through vent 40.

Carbon canister 36 eventually becomes saturated with hydrocarbon contaminants, so it must be purged before this occurs to maintain effectiveness. Under certain engine operating conditions, as is well known in the evaporative emissions control art, the canister 36 is purged of pollutants by opening purge valve 42 (vent valve 38 is also open) so that ambient air can be drawn in through vent 40, pass through canister 36 to desorb hydrocarbons stored in the canister, and be drawn into engine 30 and burned during normal engine operation.

For such a pressurized tank vapor recovery system to work properly, fuel vapors must be allowed to escape from tank 12 only through vapor recovery line 28 as described above. When a vehicle operator desires to refuel the vehicle, the vehicle is stopped at a fuel filling station or the like, engine 30 is shut off, and the operator actuates a refuel input device 46 with the intent of opening door 22 to gain access to refueling compartment 18 and inlet opening 16. Refuel input device 46 may, for example, be a switch (such as a tab, lever, knob, button, etc.) marked and/or labeled as a door latch release actuator such as are commonly used in vehicles that have an in-cabin release for a lockable/latchable refueling access door.

Before inlet opening 16 is opened to insert a refueling nozzle (not shown), the pressure in fuel tank 12 must be reduced to be approximately equal to atmospheric pressure so that fuel vapors do not escape from tank 12 through tank inlet 14 and inlet opening 16. Accordingly, it is desired to impede opening of the fuel tank inlet if the tank pressure is above a desired limit.

To achieve this, the system shown in FIG. 1 employs appropriate control logic to prevent unlocking of latch 24 until proper conditions exist to minimize the escape of fuel vapors. When refuel input device 46 is actuated by a vehicle occupant, an unlock request signal is sent to controller 44, but the actual unlocking of latch 24 is prevented or delayed until pressure transducer 32 indicates that the fuel vapor pressure inside tank 12 has decreased to an appropriate level. Opening of fuel door 22 and access to inlet opening 16 is thus prevented until appropriate conditions exist.

To reduce the pressure in tank 12, controller 44 commands isolation valve 34 to an open condition, thereby permitting fuel vapors to flow from the tank to carbon canister 36 where they are scrubbed. Only after pressure transducer 32 indicates an appropriately low pressure is latch 24 commanded to the unlock condition so that door 22 may be opened to permit refueling.

Controller 44 is preferably a microcomputer-based device and may be a stand-alone controller or may be implemented via software on a multi-purpose electronic controller, such as a powertrain control module (not shown).

Figure 2:
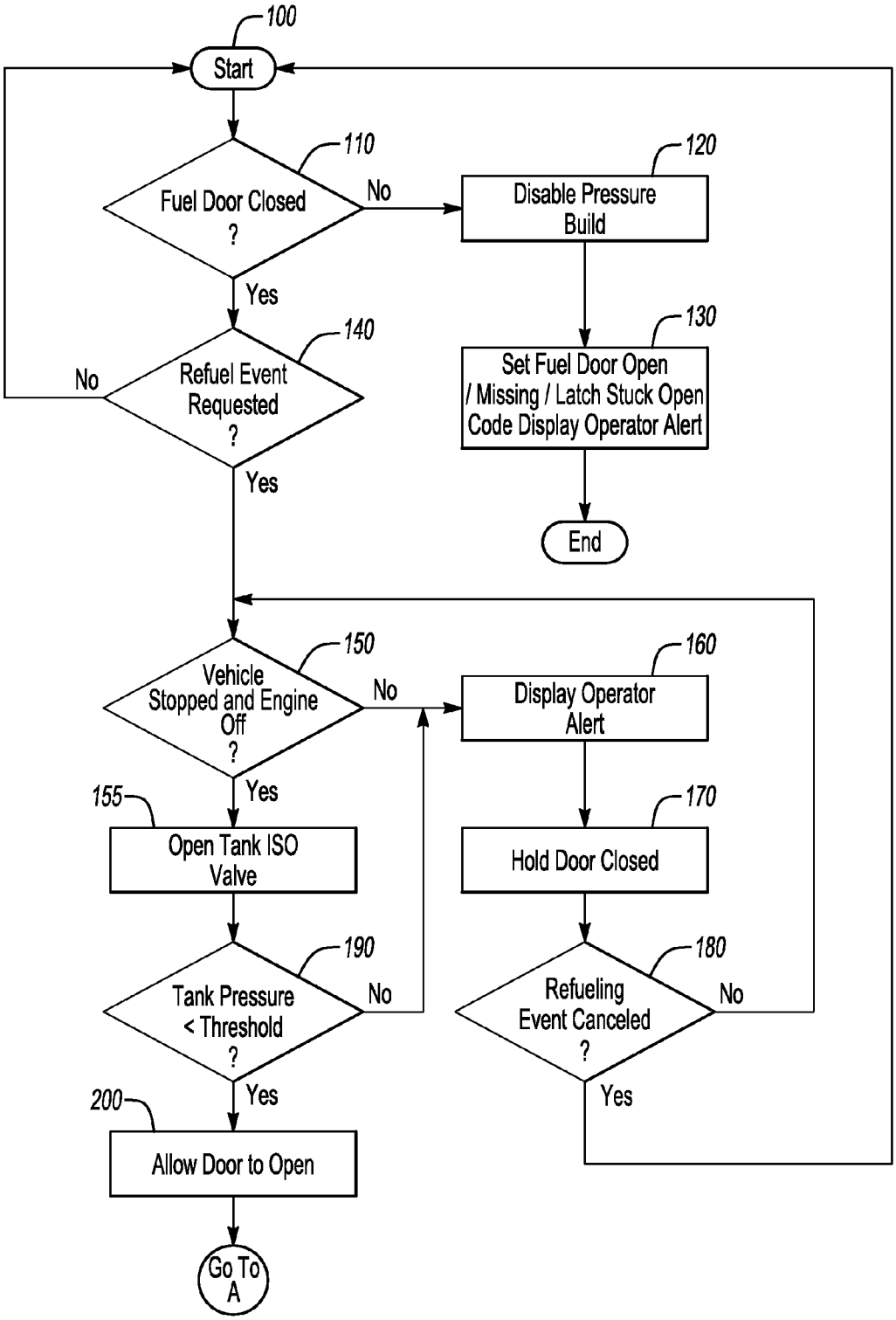
FIG. 2 is a block diagram showing the logic flow for an algorithm for determining if an inlet access door is opened and whether the vehicle is in a proper state to be refueled.

A control algorithm implemented by controller 44 is illustrated in flow chart form in FIG. 2. At the start 100, the vehicle may be engine on, engine off, moving, or stationary. At block 110, controller 44 reads a signal from door sensor 26 to determine whether or not fuel door 22 is closed. If the fuel door is not closed, the method progresses to block 120 where pressurization of tank 12 is disabled. This may be achieved by opening tank isolation valve 34. The method progresses to block 130 where an operator alert is generated to notify the vehicle operator that the fuel pressurization system is not operating properly. In addition, at block 130, a fault code may be set in a vehicle on-board diagnostic system and/or may be wirelessly communicated to an off-board system (not shown). The operator alert may be a malfunction indicator light, an audible alert, or any appropriate signal to notify the driver of the condition.

At block 110 if the fuel door is detected to be closed, the method progresses to block 140 where controller 44 detects whether the operator has requested a refueling event, for example by actuating refuel input device 46. When a refuel event is requested, the method progresses to block 150 where vehicle systems such as a powertrain control module are monitored to determine whether or not the vehicle is stopped and its ignition system is switched off. If both of these conditions are met, the method progresses to block 155 where the accumulated pressure in the fuel system is relieved by, for example, opening a tank isolation valve.

The method then progresses to block 190 where pressure in the fuel tank is read to determine whether or not it is below a threshold level. The threshold level is preferably close to atmospheric pressure. As discussed above, a lowering of tank pressure is preferably achieved by opening a tank isolation valve. If the tank pressure detected is below the threshold value at block 190, at block 200 access to the fuel tank inlet is allowed by, for example, allowing the inlet access door to be opened. In the system embodiment shown in FIG. 1, this is achieved by directing latch 24 to withdraw plunger **24*a* from lock plate 22*a*, thereby unlocking the door 22**.

If at block 190 the fuel tank pressure is not below the threshold level, an operator alert is generated at block 160 to notify the vehicle operator that the refueling cannot be initiated until the fuel tank pressure is below the threshold level.

If at block 150 the vehicle is not stopped and engine/ignition off, an operator alert is generated at block 160 to notify the vehicle operator that the refueling cannot be initiated until the engine is off.

At block 170, access to the fuel tank inlet is impeded by, for example, keeping a refueling access door closed. At block 180, a check is made of whether the refueling event request has been cancelled by the operator, and the method returns to start block 100 if it has been cancelled. If the refueling event request is not cancelled, the algorithm returns to block 150 to check on the vehicle status and allow refueling when the proper conditions are met.

Figure 3:
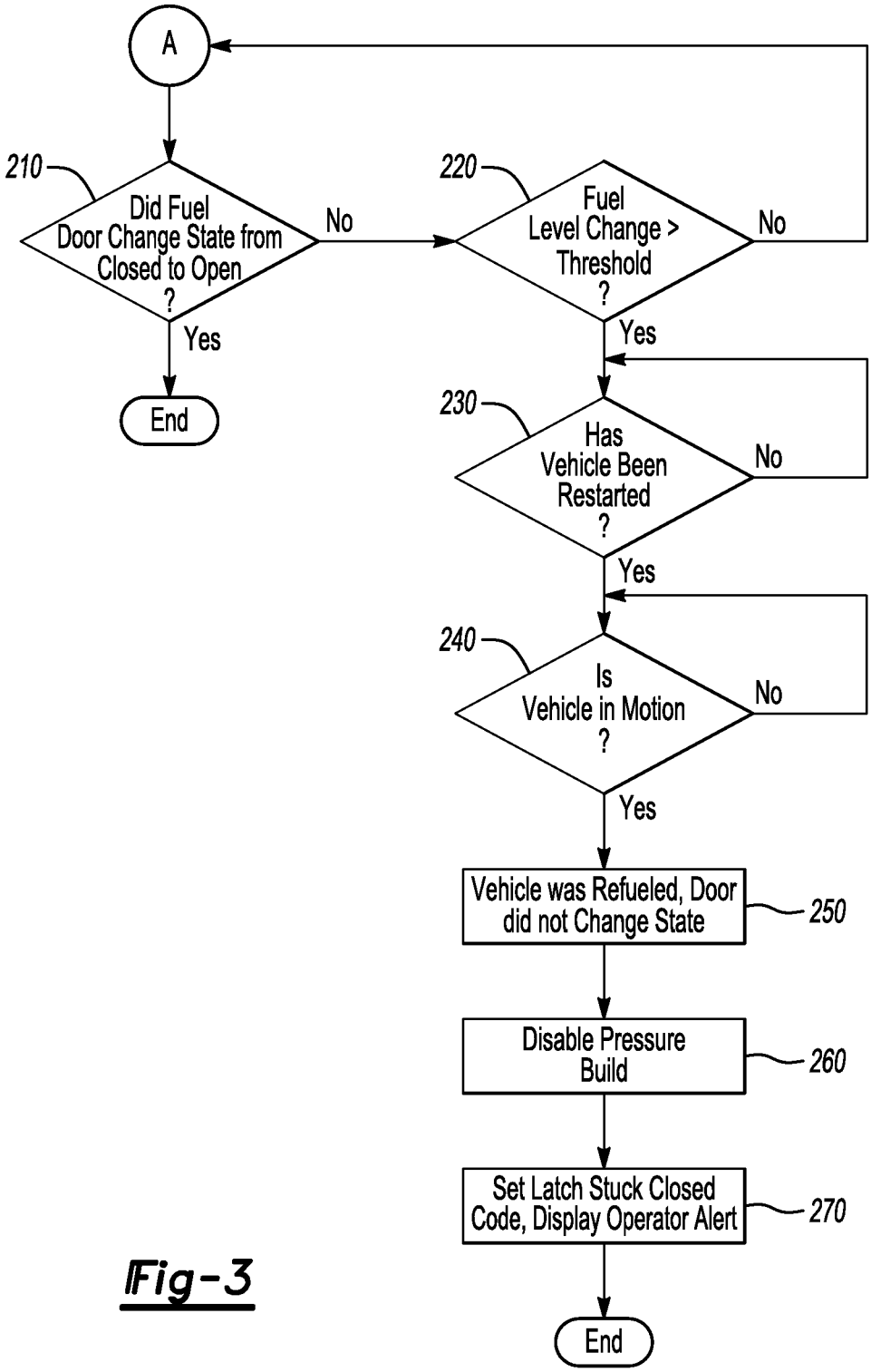
FIG. 3 is a continuation of the algorithm of FIG. 2 for determining whether the inlet access door and/or latch are in a correct state after refueling.

After the door has been allowed to open at block 200, it is assumed that a refueling event has taken place. Progressing to block 210, the fuel inlet access door status is monitored to determine whether the door was actually opened after being unlocked. The portion of the algorithm shown in FIG. 3 is a diagnostic check to ensure that door and related condition monitoring sensor(s) are operating properly. If at block 210, a door sensor indicates that the refueling access door was not opened, a fuel tank level sensor (not shown) is checked to determine whether or not the level of fuel in the tank has increased. If the fuel level increase is less than a threshold value (block 220, NO) this indicates that the refueling process has most likely been aborted for some reason so the algorithm returns to block 210. If the fuel level has increased by more than the threshold amount, the method progresses to block 230 where a check is made of whether the vehicle has been restarted. If yes, the method progresses to block 240 where a check is made of whether the vehicle is in motion. If yes, the method progresses to block 250 where the combination of states in blocks 210 through 240 are used to infer that the vehicle has been refueled but the door 22 was not detected as changing its state from closed to open. This combination of readings/indications may indicate either a false reading from a door condition sensor (stuck or otherwise inoperative), or that the fuel access door was missing or otherwise damaged in a manner allowing the fuel filler nozzle to be inserted into the inlet opening 16. In either of these cases, the method progresses to block 260 where the pressure build-up in the tank is disabled, for example, by opening tank isolation valve. Progressing to block 270, an operator alert is generated and a fault code is set in a vehicle on-board diagnostic system.

The disclosed fuel system monitoring and diagnostic system is thus able to detect at least the following five types of faults or failures that will interfere with proper operation of the system: 1) Refueling access door open while vehicle is in motion; 2) Refueling access door missing or damaged; 3) Door condition sensor stuck open (mechanically or electrically); 4) Door condition sensor stuck closed (mechanically or electrically); and 5) Vehicle in incorrect state to allow refueling.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

What is claimed is:

1. A method of diagnosing failure of a fuel inlet access door condition sensor and preventing pressurization of a fuel tank of a vehicle after a refueling event, comprising:

detecting that the sensor has not changed from a door closed to a door open indication;

detecting that a fuel level inside the fuel tank has increased by more than a threshold amount;

detecting that a vehicle engine has been restarted; and in response to the above conditions, inferring a failure of the sensor and preventing closing an isolation valve that, when closed, isolates the fuel tank from a vapor recovery canister.

2. The method according to claim 1 further comprising the step of detecting that the vehicle is in motion and preventing closing of the fuel tank isolation valve if the vehicle is in motion.

3. The method according to claim 1 further comprising:

generating an occupant alert indicating that pressure buildup is disabled.

4. The method according to claim 1 further comprising the step of:

setting a fault code in a vehicle diagnostic system if pressure buildup is disabled.

5. The method according to claim 1 wherein the open/closed status of the fuel inlet access door is detected by a contact sensor.

6. A method of preventing pressurization of a vehicle fuel tank after a refueling event, comprising:

disabling closing of an isolation valve between the tank and a vapor recovery canister in response to: a) an open/closed status of a fuel inlet access door not changing from closed to open, and b) a fuel level inside the tank increasing, and c) a vehicle engine restarting.

7. A method of preventing pressurization of a vehicle fuel tank if a fuel inlet access door is not confirmed closed after refueling, comprising:

detecting a fuel level increase inside the tank;

detecting that the inlet access door has not changed status from closed to open;

detecting that the vehicle is motion; and in response to the above conditions, preventing closing of a valve that, when closed, isolates the tank from a vapor recovery canister.

* * * * *